US008185992B2

(12) United States Patent
Linsbichler et al.

(10) Patent No.: US 8,185,992 B2
(45) Date of Patent: May 29, 2012

(54) HAND-GUIDED DEVICE AND TOOL CONNECTABLE THERETO

(75) Inventors: Johannes Linsbichler, Vienna (AT); Werner Wolf, Thörl (AT)

(73) Assignee: QXR Cleaning Products GmbH, Vienna (AT)

( * ) Notice: Subject to any disclaimer, the term of this patent is extended or adjusted under 35 U.S.C. 154(b) by 439 days.

(21) Appl. No.: 11/794,410

(22) PCT Filed: Feb. 5, 2007

(86) PCT No.: PCT/AT2007/000054

§ 371 (c)(1),
(2), (4) Date: Jun. 26, 2007

(87) PCT Pub. No.: WO2007/087666

PCT Pub. Date: Aug. 9, 2007

(65) Prior Publication Data

US 2010/0024139 A1 Feb. 4, 2010

(30) Foreign Application Priority Data

Feb. 3, 2006 (AT) ..... A 171/2006
Feb. 3, 2006 (AT) ..... GM81/2006

(51) Int. Cl.
*A46B 13/02* (2006.01)
*A47L 23/02* (2006.01)

(52) U.S. Cl. ..... 15/28; 15/32; 15/34; 15/35

(58) Field of Classification Search ..... 15/28, 31, 15/35, 32, 34
See application file for complete search history.

(56) References Cited

U.S. PATENT DOCUMENTS

| | | | | |
|---|---|---|---|---|
| 3,239,864 | A * | 3/1966 | La Corata | 15/29 |
| 3,775,800 | A | 12/1973 | Veneziani | |
| 4,158,246 | A * | 6/1979 | Meadows et al. | 15/28 |
| 5,857,233 | A * | 1/1999 | Wynn | 15/97.1 |
| 6,185,781 | B1 * | 2/2001 | Miller et al. | 15/322 |
| 6,253,405 | B1 * | 7/2001 | Gutelius et al. | 15/22.2 |
| 2002/0104177 | A1 * | 8/2002 | Wong et al. | 15/28 |

FOREIGN PATENT DOCUMENTS

| | | | |
|---|---|---|---|
| CH | 401384 | A | 10/1965 |
| DE | 36 15 918 | A1 | 11/1987 |
| WO | WO 02/17767 | A1 | 3/2002 |

OTHER PUBLICATIONS

International Preliminary Report on Patentability dated Oct. 2, 2008.

* cited by examiner

*Primary Examiner* — Randall Chin
(74) *Attorney, Agent, or Firm* — Laurence A. Greenberg; Werner H. Stemer; Ralph E. Locher

(57) ABSTRACT

A hand-guided device has a housing and a drive component with a drive element that is movable relative to the housing by way of a motor. A tool is releasably connectable to the drive element. In order to achieve a universal usability of the device by equipping it with various tools as well as with a different way of movement each, the drive element is eccentrically mounted in the drive component with an eccentricity and on the housing, a fixed bearing is disposed at a distance from the drive element for an optional cooperation with a tool.

29 Claims, 7 Drawing Sheets

HAND-GUIDED DEVICE AND TOOL CONNECTABLE THERETO

BACKGROUND OF THE INVENTION

Field of the Invention

The invention relates to a hand-guided device comprising a housing and a drive component with a driving means movable relative to the housing by means of a motor, and a tool releasably connectable to said driving means.

Furthermore, the invention relates to tools for the above-mentioned hand-guided device, each comprising a treatment component and a guiding component, wherein on the guiding component, an element for establishing a releasable connection with the driving means of the hand-guided device is provided.

The hand-guided device may, e.g., be a device for cleaning and/or processing and/or attending to surfaces of objects, such as shoes, car parts and the like, or it may be a massage device for external application on living beings. The appropriately configured treatment component of the respective tool will be employed for cleaning, processing or for attending to the surface of the respective object.

For facilitating and/or improving operations as well as activities, hand-guided devices with a—particularly electrically drivable—tool are known in many embodiments. There, the tools carry out a rotating or rotating-oscillating movement about an axis. Devices are also known the tools of which are moved to oscillate to and fro, or to rotate eccentrically. In most instances, these hand-guided devices are single-purpose devices or devices which are provided for one certain requirement or activity, respectively.

Devices made for one process step have the advantage that the tool movement and the tool can be optimized for this and, thus, the best properties for use are provided. If, however, different operations are to be carried out later on with one and the same hand device, obviously in most instances they can be carried out only with a tool movement adapted to the respective requirements in an average manner.

WO 02/17767 A1 describes a portable shoe shining device with a housing designed as a handle, in which an electric motor with a transmission shaft for non-positive coupling with a brush is arranged. To avoide a rigid coupling between electric motor and brush, e.g. a bendable shaft is arranged as a transmission shaft. The brush carries out a rotational movement, or an eccentric oscillating movement, respectively, if the middle axis of the brush is arranged laterally offset relative to the axis of rotation of the transmission shaft. For some activities, e.g. for applying a shoe polish to a shoe, such a rotational movement is not suitable since the shoe polish may be hurled off the brush during the rotational movement and, thus, may lead to soiling.

DE 36 15 918 A1 describes a manually handleable cleaning devive by means of which the tool, e.g. a brush, can be set into a purely rotational movement or into an oscillating short stroke-rotational movement. As has already been mentioned above, for some applications a purely rotational movement of the tool is not suitable. Because of the mass inertia of the tool, an oscillating short stroke-rotational movement is not suitable, either.

SUMMARY OF THE INVENTION

The invention now has as its object to overcome the disadvantages of the prior art and to provide a hand-guided device of the initially mentioned type which can easily be equipped with various tools and which ensures a desired suitable mode of movement for, or with the respective tools, respectively.

A further object of the present invention consists in providing appropriate tools for the hand-guided device, which tools can be releasably connected to the drive component in an easy manner and with which a mode of movement suitable for the respective processing can be carried out.

According to the invention, the first object is achieved by an above-indicated hand-guided device in which the driving means is eccentrically mounted in the drive component with an eccentricity and wherein a fixed bearing is arranged on the housing at a distance from the driving means for a possible cooperation with a tool. The advantages which can be obtained with the tool consist substantially in that, without having to touch the chosen tools, different types of tool are connectable to the working component and releasable therefrom again, wherein simultaneously with establishing the operative connection, the best type of the respective tool movement is adjusted.

In order to be able to process, or treat, respectively, larger areas in shorter periods of time with the hand-guided device, according to the invention it may be provided for the working component to comprise, at a distance, at least two orbitally movable driving means which are connectable to the tool in a releasable operative connection.

According to one feature of the invention, it is provided for the driving means to comprise a means for achieving a positively locked connection with the tool.

In order to achieve further modes of movement with appropriately designed tools, at least one undercut portion or the like can be provided on the housing of the hand-guided device for anchoring a snap-in nose or the like of a tool. In this manner, e.g. faster rotating tools can be connected more securely to the hand-guided device, as will be described, e.g., in the tool described further below and designed as a so-called dirt milling tool.

If, according to one embodiment of the invention, the drive component comprises a driving means to which the tool is connected in a releasable operative connection, which tool comprises a treatment component and a guiding component, wherein, on the guiding component, a bearing for the driving means and gaps for receiving the fixed bearing are centrally provided, the tool will be moved generally oscillatingly. In operation, the tool thus will carry out an eccentrically rotating, or orbiting movement, respectively, in the region of the driving means, wherein the spaced-away, unmovable fixed bearing prevents a circular movement of the tool and allows only for shifting of the latter in one direction.

The gaps on the guiding component of the tool for receiving the fixed bearing preferably are arranged in star shape. In this manner, several possibilities are provided for receiving the fixed bearing and, thus, slipping the tool onto the hand-guided device is facilitated.

In a further embodiment of the invention, it may be provided for the drive component to comprise at least one driving means to which the tool is connectable in a releasable operative connection, which tool is designed in axial symmetry and comprises a treatment component and a guiding component, wherein a bearing for the driving means is provided centrally on the guiding component, resulting in an orbital circulating movement of the tool. Here, the tool is rotatably mounted in the driving means and, when not loaded, can carry out an orbitally circulating and a rotating movement. If, however, the tool is put at a work piece, the friction occurring therewith will prevent a rotation so that an orbital movement will prevail during use.

An embodiment according to the invention also consists in that the drive component comprises at least one eccentrically movable driving means, to which the tool is connectable in releasable operative connection, which tool comprises a treatment component and a guiding component, wherein a bearing for the driving means is eccentrically provided on the guiding component.

If the eccentricity of the bearing substantially corresponds to the eccentricity of the driving means, a rotating movement of the tool will result.

Despite an eccentrically, or orbitally, respectively, moved driving means, a circular movement of the tool about an axis can be achieved by an eccentricity of the connecting means on the tool, wherein releasable positive locking will ensure an axial rotation. The positive locking means may be designed in various ways. For instance, a notch may be provided on the driving means, or a crown collar connected to the driving means, which crown collar acts like a claw coupling.

According to a further embodiment of the invention, the drive component comprises a driving means to which the tool is connectable in releasable operative connection, and the tool comprises a treatment component with at least one rotatably mounted brush and a housing, which tool-housing has a groove for receiving the fixed bearing, and in that furthermore a coupling element operatively connected to the at least one brush is provided for establishing a connection with the driving means, resulting in a rotational movement of the at least one brush of the tool. As a consequence of these features, a tool can be connected to the hand-guided device which has a housing from which at least one rotatably mounted brush projects. Preferably, several brushes are arranged with different directions of rotation, whereby, e.g., a particularly high cleaning effect can be achieved with such a tool.

In order to obtain a secure connection between the hand-guided device and the tool-housing, at least one snap-in nose or the like can be provided on the tool-housing to establish a connection with at least one undercut portion on the housing of the hand-guided device. Such a secure connection is advantageous or even required if higher centrifugal forces occur during use of the tool.

To adapt the rpm of the at least one brush and also to allow for several brushes to be driven by one driving element, the coupling element preferably is connected to the at least one brush via a gearing.

When using several brushes, the gearing may preferably be formed by a planetary gearing, wherein the center wheel of the planetary gearing is operatively connected to the coupling element and one planetary wheel each is operatively connected to a brush. For instance, a tool with three brushes may be produced, each of which is non-rotationally connected to a toothed wheel. These toothed wheels constitute the planetary wheels which are arranged around the center wheel. Thereby, the three brushes will move in rotationally opposite direction each. In this manner, a so-called dirt milling tool can be constructed which is particularly well suited for removing dirt from the surface of objects, such as, e.g., shoes.

Advantageously, attaching the tool to the driving means and releasing it threfrom is achieved in that the operative connection of the tool in axial direction of the driving means is provided by resilient parts in a detent, which operative connection is releasable by means of the pressure force of an ejector pin acting on the tool and overcoming the resilience in the detent. Thus, with a simple pressure on a button, without touching the tool by hand, the tool can be released from the device and moved into a receptacle provided therefor.

Preferably, the motor is formed by an electric motor.

The further object according to the invention is achieved by an above-indicated tool in which the connecting element is formed by a bearing centrally arranged on the guiding component, and in which, furthermore, gaps are provided on the guiding component for receiving the fixed bearing of the hand-guided device, resulting in a swinging (oscillating) movement of the tool. Such a tool is particularly well suited for applying pasty substances to the surface of, e.g., shoes, since due to the oscillating movement of the tool, there is no hurling off of the pasty substance. In a rotating tool, particularly when using more liquid substances, the latter would be hurled off and, thus, an undesired soiling of the surroundings or of the user of the device would occur.

Advantageously, the gaps on the guiding component for receiving the fixed bearing of the hand-guided device, which are required for the resulting oscillating movement of the tool, are arranged on the guiding component in star shape. By this, the fixed bearing of the hand-guided device may be accommodated at different positions of the guiding component, and when connecting the tool to the hand-guided device, no attention need be paid to the exact orienting of the latter with regard to the fixed bearing. This facilitates handling and, thus, increases the acceptance of the device.

The treatment component of the above tool preferably is formed by a sponge body. Depending on the nature of its material, such a sponge body may be employed for different applications. A comparatively hard sponge material having large pores will, e.g., be suitable for brushing up suede leather.

Advantageously, a pasty substance, such as a cream or the like, is provided in the sponge body. In this manner, a tool can be created by means of which a pasty substance can be applied to the surface of an object. The tool may, e.g., be a means for applying a leather care cream to the surface of leather shoes. The sponge body may be soaked with the pasty substance or with an appropriate liquid, respectively, or the latter may be arranged in a hollow body provided therefore.

The sponge body may be formed by a sponge ring and an applicator connected thereto, the pasty substance being provided in the interior of the sponge ring and the applicator being made of a material permeable for the pasty substance. By this structure, the production of such a tool is facilitated, with the tool at the same time having good properties. Sponge ring, applicator and guiding component of the tool preferably are glued to each other. By the two-part design of the sponge body as a sponge ring and an applicator, the pasty substance present within the sponge ring can be conveyed selectively through the applicator to the outside by making the sponge ring of a material which is not permeable or only poorly permeable to the pasty substance. It is, of course, also possible to produce the sponge ring integrally with the applicator in one piece.

Advantageously, a cover cap is arranged over the treatment component of the tool. Thus, soiling by the pasty substance can be prevented, and the pasty substance can be protected against drying up.

Preferably, the cover cap is releasably connected to the guiding component, e.g. by a type of bayonet lock.

The object according to the invention is also achieved by a tool in which the connecting element is formed by a bearing centrally arranged on the guiding component, resulting in an orbitally circulating movement of the tool. In this manner, a tool can be produced which, e.g., is particularly well suited for polishing surfaces.

In this instance, the treatment component preferably is formed by a synthetic fur or by a textile material. Of course, also other materials, such as non-woven fabrics or natural furs can be used as treatment component.

The object according to the invention is also achieved by a tool, in which the connecting element is formed by a bearing eccentrally arranged on the guiding component. With such an embodiment, other patterns of movement can be achieved which are of advantage for certain applications.

In particular, a rotating movement of the tool can be achieved if the eccentricity of the bearing substantially corresponds to the eccentricity of the driving means. Such a tool may preferably be used especially for cleaning surfaces of various objects.

In this instance, the treatment component preferably is formed by bristles.

Finally, the invention is also achieved by an above-indicated tool in which the treatment component comprises at least one rotatably mounted brush, wherein furthermore a housing with a groove for receiving the fixed bearing of the hand-guided device is provided, wherein the connecting element is formed by a coupling element operatively connected to the at least one brush, resulting in a rotational movement of the at least one brush of the tool. By these features, a tool with preferably several rotatably arranged brushes is created, with which a particularly high cleaning effect can be achieved.

In order to obtain a secure connection between the hand-guided device and the tool-housing, at least one snap-in nose or the like may be provided on the tool-housing for establishing a connection with at least one undercut portion on the housing of the hand-guided device. Such a secure connection will be of advantage or even necessary if higher centrifugal forces occur when using the tool.

In order to be able to adapt the rpm of the at least one brush and also to drive several brushes with one driving element, the coupling element is connected to the at least one brush via a gearing.

When using several brushes, the gearing may preferably be formed by a planetary gearing, wherein the center wheel of the planetary gearing is operatively connected to the coupling element and one planetary wheel each is operatively connected to a brush. For instance, a tool having three brushes can be made, each being non-rotationally connected to one toothed wheel. The toothed wheels form the planetary wheels which are arranged around the center wheel of the planetary gearing. Thereby, the three brushes each move in rotationally opposite directions. In this manner, a so-called dirt milling tool can be constructed which is particularly well suited for removing dirt from surfaces of objects, such as shoes, e.g.

In the following, the invention will be explained in more detail by way of drawings illustrating various exemplary embodiments. Therein,

DESCRIPTION OF THE INVENTION

Figure 1:
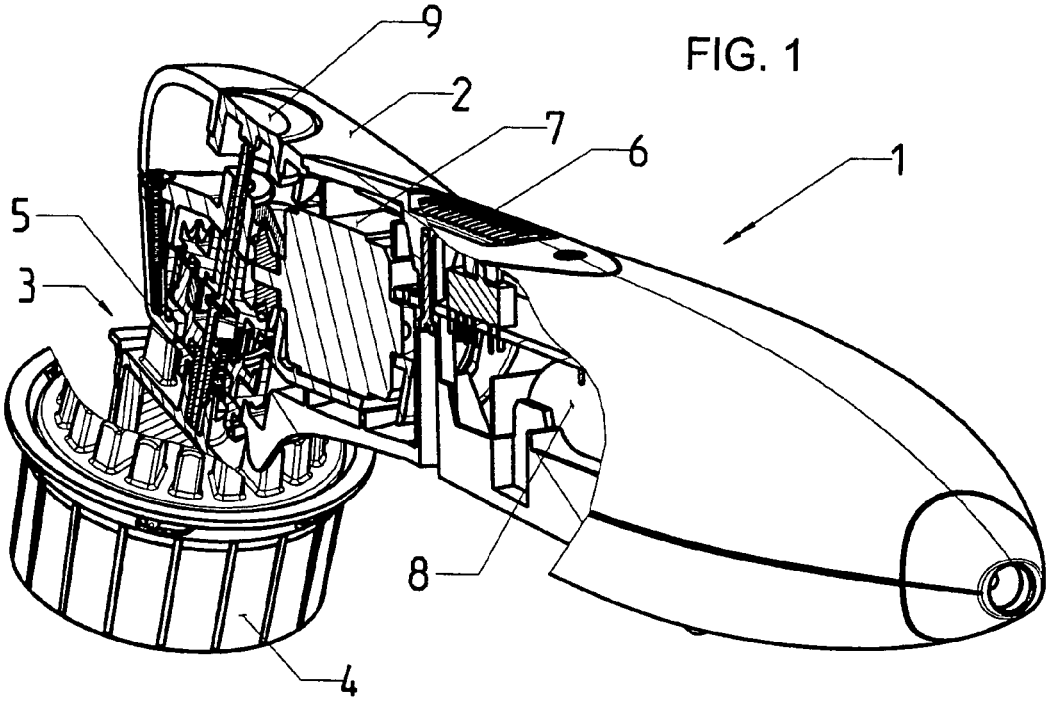
FIG. 1 shows a perspective, partially sectioned view of an embodiment of the hand-guided device.

FIG. 1 shows a perspective view of an embodiment of the hand-guided device 1 according to the invention in a partially sectioned illustration. The hand-guided device 1 comprises a housing 2 and a drive component 3 with a driving means 5 that is movable relative to the housing 2 by means of a motor 7. A tool 4 can be releasably connected to the driving means 5. The motor 7 is particularly supplied with electric energy by batteries 8 or by rechargeable batteries. Recharging of the rechargeable batteries may be effected in a suitable manner via a docking station in which the device 1 is arranged. The electric energy may be transmitted via a plug, appropriate contacts on the device 1 or by means of induction (not illustrated). An operating element 6 allows the device 1 to be set into operation. By means of an ejector 9, the tool 4 can be released from the driving means 5, preferably without contacting it and, thus, without risk of soiling. According to the invention, the hand-guided device 1 is configured such that it can be equipped with various tools 4, 4', 4", 4'" described hereinafter by way of FIGS. 2 to 8. The tools 4, 4', 4", 4'" are designed such that different types of movement of the same can be achieved and, thus, for certain activities the respective suitable tool 4, 4', 4", 4'" can be used.

Figure 1A:
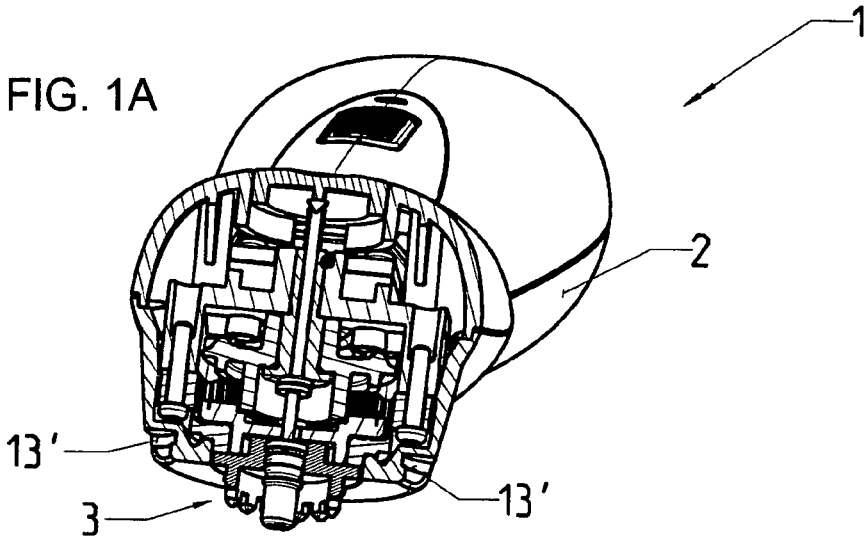
FIG. 1A shows a further perspective, partially sectioned view of the hand-guided device according to FIG. 1.

FIG. 1A shows a further perspective view of the hand-guided device 1 which is sectioned in the region of the drive component 3. Within the housing 2 of the device 1, there are two undercut portions 13' which may serve for anchoring snap-in noses 37 or the like of a tool 4'" (cf. FIGS. 8, 8A and 8B), whereby a better retention of the tool 4'" on the device 1 is achieved. Of course, also several undercut portions 13' may be provided in various configurations on the housing 2 of the device 1.

Figure 2:
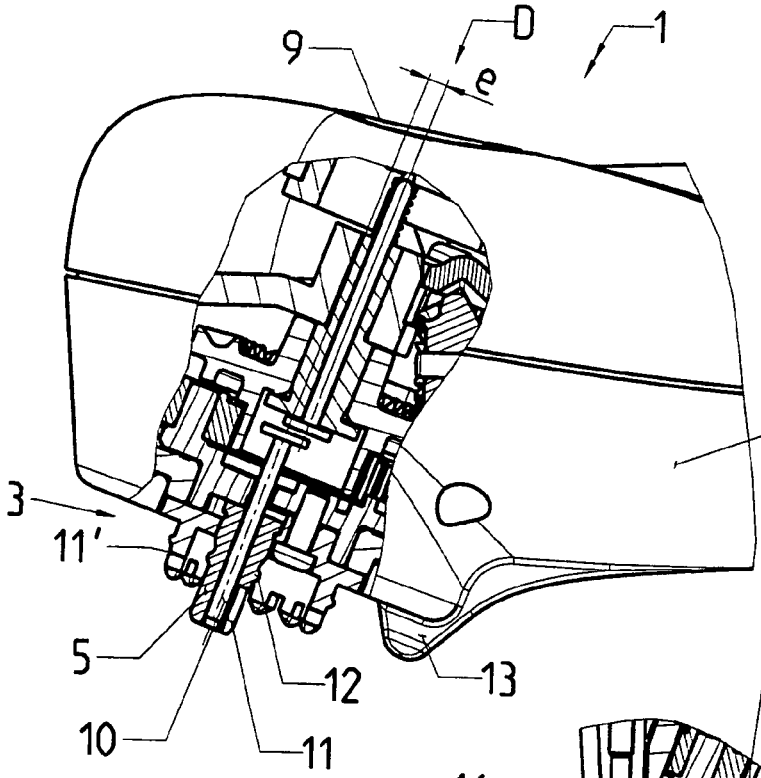
FIG. 2 shows a cut-out portion of the hand-guided device in the region of the drive component in a partially sectioned illustration.

FIG. 2 is a sectional illustration of a cut-out portion of the hand-guided device 1 in the region of the drive component 3. A downwardly projecting driving means 5 is eccentrically movably mounted in the drive component 3 with an eccentricity e and comprises a detent 12 for arresting a tool 4, 4', 4", 4'" (not illustrated) in the direction of the axis. Furthermore, the driving means 5 has a positive locking means which, e.g., may be formed by an indentation 11 on the driving means 5 or by a crown collar 11' connected to the driving means 5. By pressing on the ejector 9 (cf. FIG. 1), an ejector pin 10 can be shifted in the direction of the arrow D towards the tool 4, 4', 4", 4'" (not illustrated) and by this the tool 4, 4', 4", 4'" can be separated from the driving means 5.

A stationary fixed bearing 13 is arranged on the housing 2 of the device 1 at a distance from the driving means 5. By the eccentric mounting of the driving means 5, on the one hand, and this fixed bearing 13, on the other hand, different types of movement of differently designed tools 4, 4', 4", 4'" can be achieved. In the following, a few exemplary embodiments of tools 4, 4', 4", 4'" will be described.

For instance, in order to avoid pasty substances, such as creams (or shoe polishes) and the like, to be hurled outwards or off the tool 4 when applying the former to the surface of objects, a device 1 may be used with a tool 4 in the form of a cream sponge as illustrated according to the invention in FIGS. 3, 3A, 4 and 5.

Figure 3:
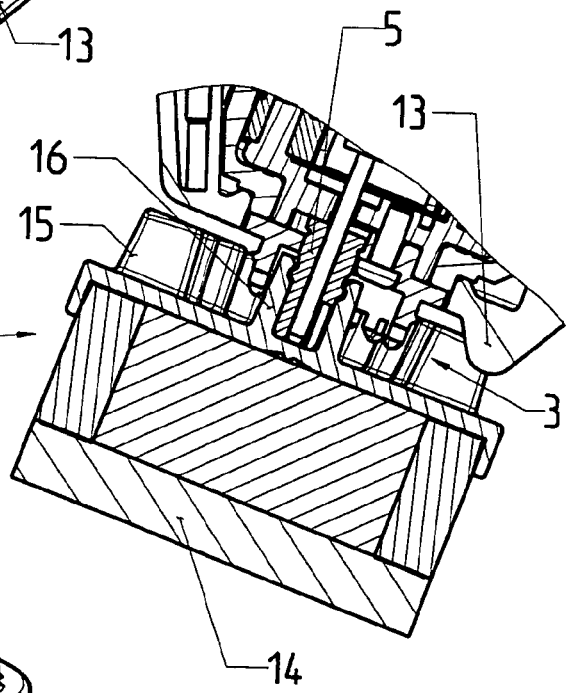
FIG. 3 shows a cut-out portion of the hand-guided device in the region of the drive component with a tool formed by a cream sponge.
Figure 3A:
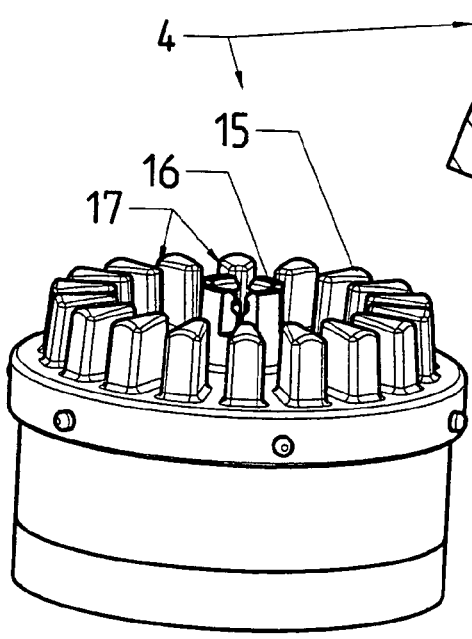
FIG. 3A shows the tool according to FIG. 3 in a perspective view.

FIG. 3 shows a drive component 3 with a movable driving means 5 which is rotatably connected to the tool 4. The tool 4 in this case has a guide component 15 and a treatment component 14, e.g. a sponge body impregnated with a pasty substance. The guide component 15 of the tool 4 centrally has a rotatable bearing 16 for the driving means 5 and, in star-shaped configuration, gaps 17 for receiving the fixed bearing 13 of the device 1.

When inserting the tool 4 in the driving means 5, a rotationally secure guiding of the same is achieved at the same time in the peripheral region via a gap 17 in the guide component 15 and the fixed bearing 13. An orbital movement of the driving means 5 in cooperation with the distant fixed bearing 13 now will result in a general oscillating movement of the tool 4, whereby hurling outwards or off of the pasty substance is avoided.

Figure 4:
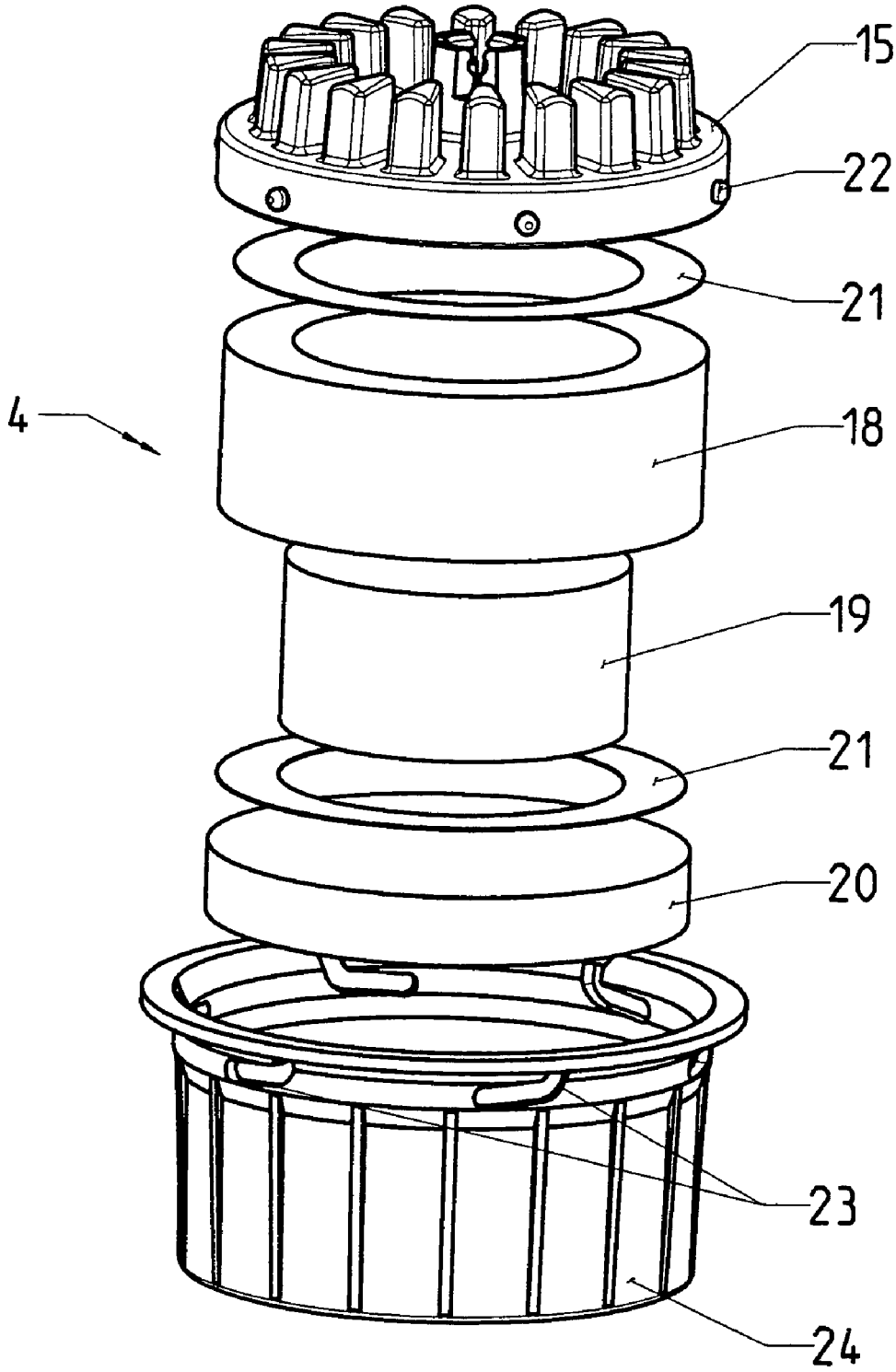
FIG. 4 shows a further embodiment of a tool formed by a cream sponge in an exploded illustration.

In an exploded illustration, FIG. 4 shows a further embodiment of such a tool 4 designed as a cream sponge. Tool 4 consists of a treatment component 14 and the guide component 15 (cf. FIG. 3). The treatment component 14 comprises a sponge ring 18, within which the pasty substance 19 is arranged. The sponge ring 18 is provided with adhesive layers 21 on either side thereof, and is glued to the guide component 15, on the one hand, and to a disk-shaped applicator 20, on the other hand. The applicator 20 is produced from a suitable material, in particular foamed material with pores which are permeable for the pasty substance 19. Thus, it is ensured that the pasty substance 19 can pass to the outside in dosed manner via the applicator 20 so as to apply it to the surface of a shoe, e.g. Advantageously, projections 22 are arranged on the periphery of the guide component 15, which projections engage in corresponding grooves 23 of a cover cap 24 such that the treatment component 14 of the tool 4 can be completely enclosed by the cover cap 24. In this manner, the tool 4 designed as a cream sponge can be transported and stored without the risk of soiling. Moreover, the cover cap 24 will protect the pasty substance 19 against drying up. The sponge ring 18 has a certain elasticity so that the pasty substance 19 accommodated therein can be pressed to the outside via the applicator 20 by pressing it against the object to be cleaned, a shoe, e.g. The porosity of the applicator 20 must be adapted to the consistency of the pasty substance 19. An embodiment according to which a compressible bellows of synthetic material is arranged instead of the sponge ring 18 is also conceivable.

Figure 5:
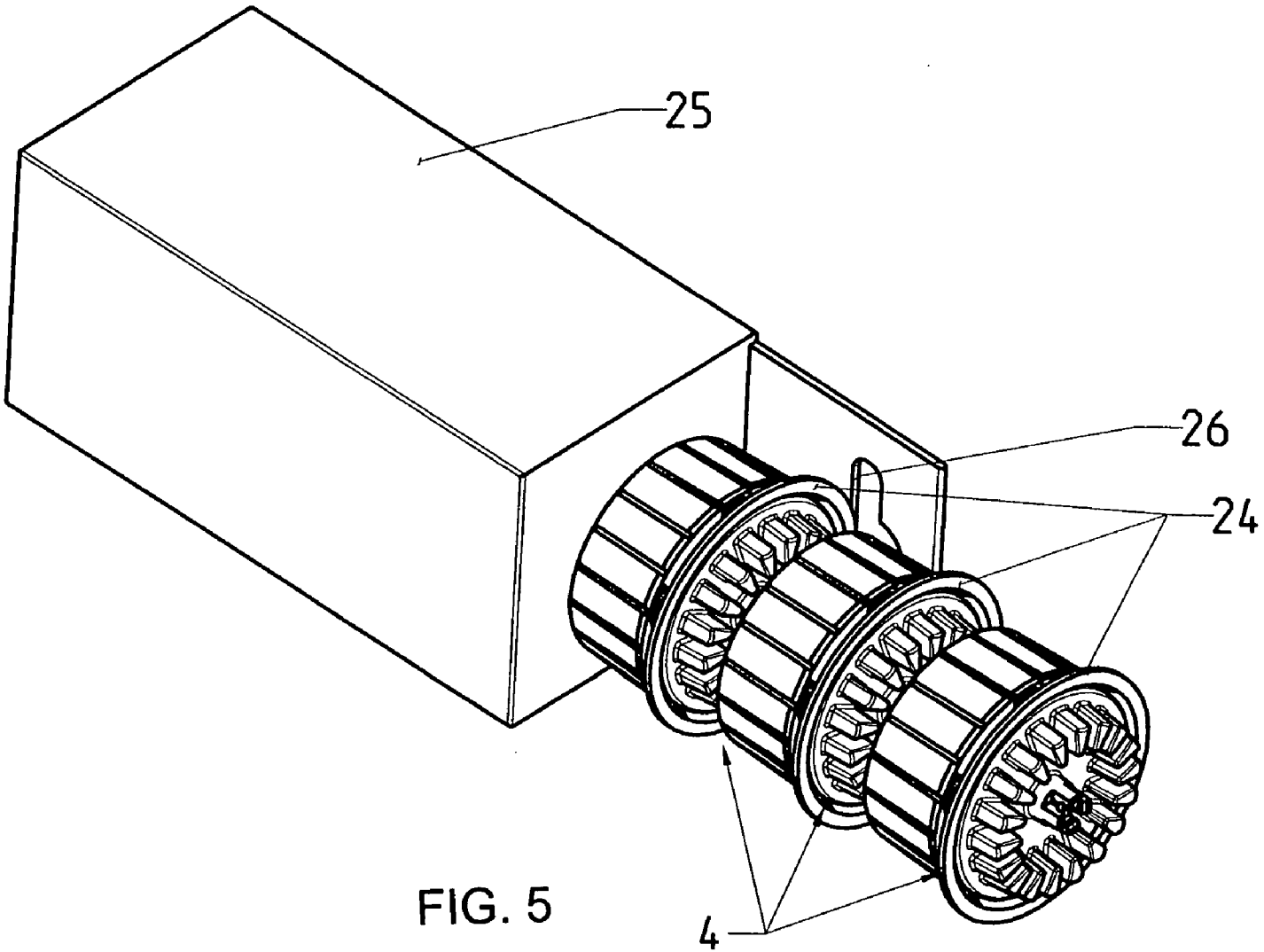
FIG. 5 shows a unit comprised of three tools formed by cream sponges according to FIG. 4.

FIG. 5 shows a package unit consisting of three tools 4 designed as cream sponges, each with cover cap 24 applied thereon. The entire unit is surrounded by a packaging means 25 which may have an appropriate Euro perforation 26. In case of cream sponges for applying shoe polish to the surface of shoes, e.g. cream sponges in the colors black, brown and colorless would have to be arranged in a packaging means 25. Basically, these tools 4 designed as cream sponges are designed as disposable products, since refilling thereof would be relatively complex and would involve the risk of the user getting dirty.

Figure 6:
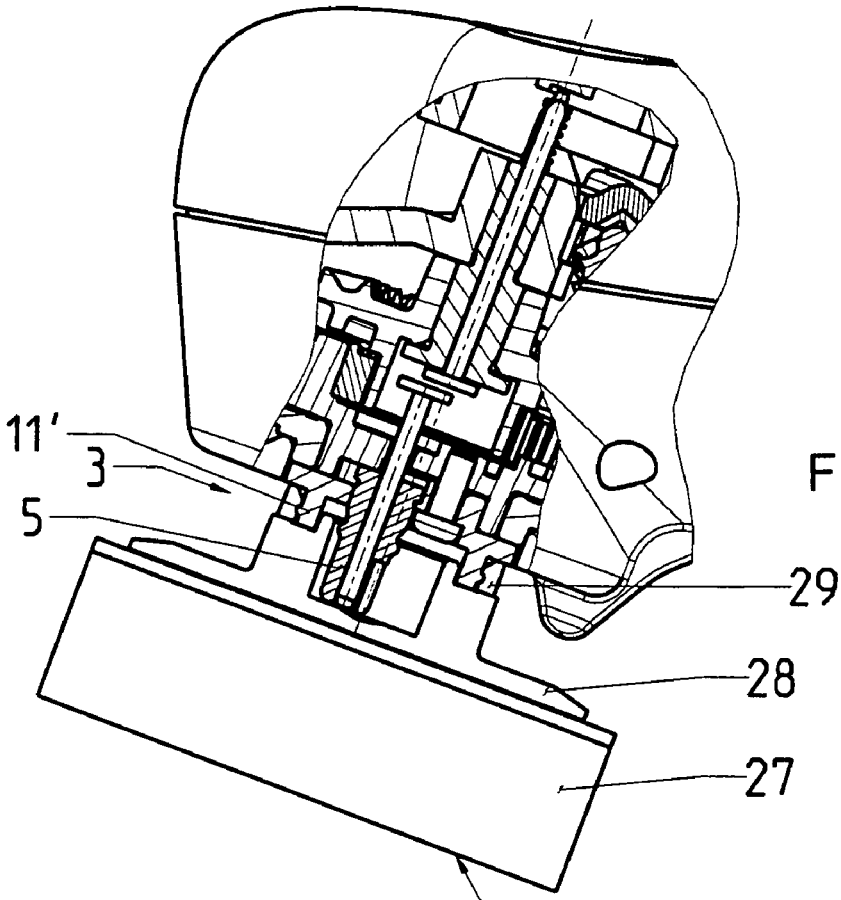
FIG. 6 shows a cut-out portion of the hand-guided device in the region of the drive component with a tool formed by a polishing disk, in a partially sectioned view.
Figure 6A:
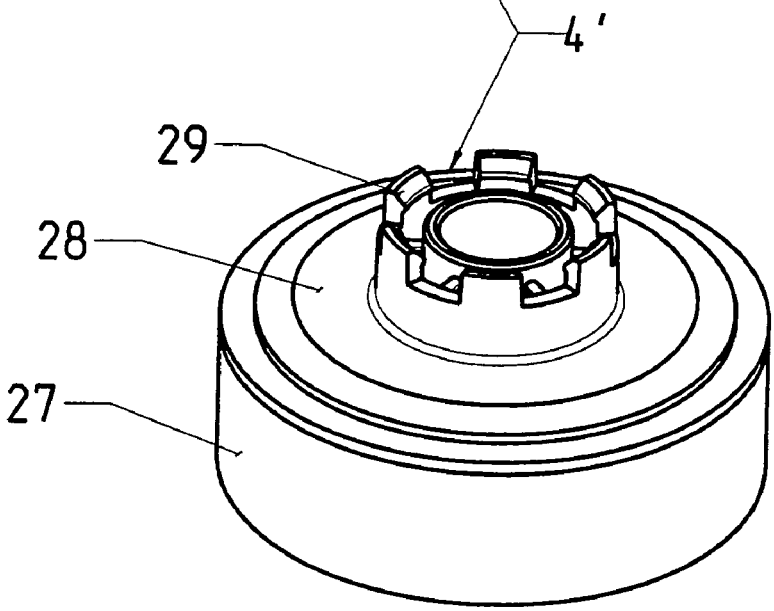
FIG. 6A shows the tool according to FIG. 6 in a perspective illustration.

FIGS. 6 and 6A show a tool 4' rotatably connected to a driving means 5, which tool may, e.g., serve as polishing tool. The symmetrical tool 4' with the treatment component 27 and the guiding component 28 is connected to the crown collar 11' of the drive component 3 via bearing 29. From this there results a rotating movement of the tool 4'. The treatment component 27 may, e.g., be formed by a synthetic fur or by a textile material. As an alternative, also a rotatable mounting of the tool 4' via the eccentrically mounted driving means 5 would be possible (not illustrated). In that case, suitably the tool 4' would be orbitally moved in circles when applying the treatment component 27 to a work piece while avoiding a rotation, whereby, e.g. also polishing jobs can be carried out on the surfaces of objects.

Figure 7:
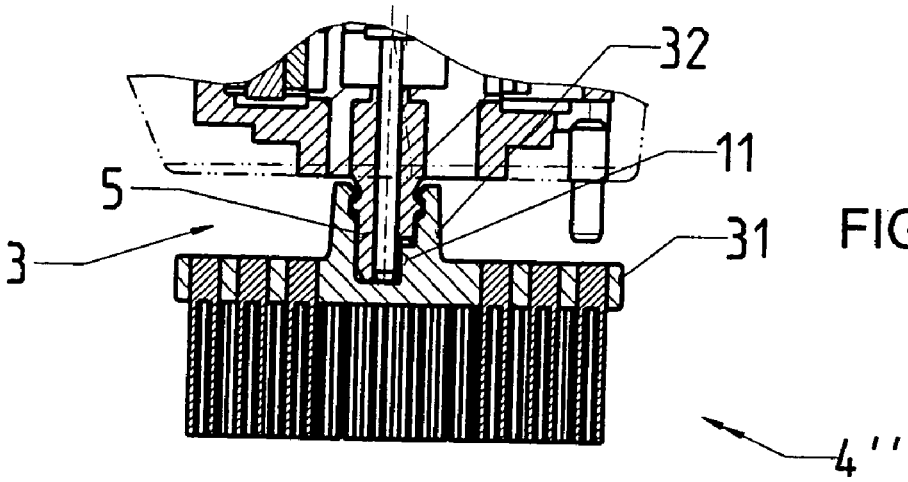
FIG. 7 shows a cut-out portion of the hand-guided device in the region of the drive component with a tool formed by a brush.
Figure 7A:
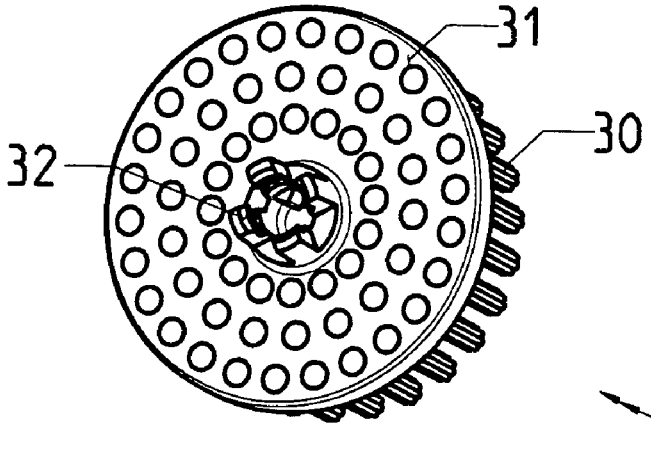
FIG. 7A shows the tool according to FIG. 7 in a perspective view.
Figure 7B:
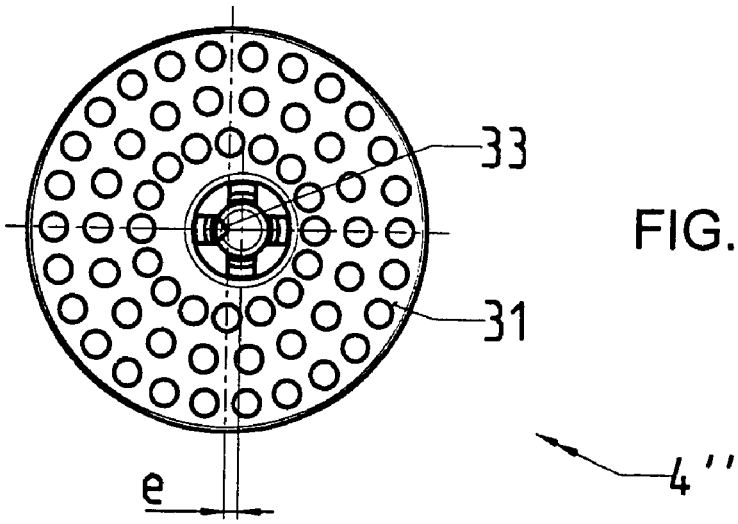
FIG. 7B shows the tool according to FIG. 7 in a top view.

For a cleaning with an ablation and removal of particles from the area of activity of the tool, for avoiding damage and scratches on the surface, according to the invention the device 1 may be operatively connected to a tool 4", which tool 4", as illustrated in FIGS. 7, 7A and 7B, can be moved in an axially rotating manner. The tool 4" designed as a brush again is formed from a guiding component 31 having a bearing 32 on the driving means 5, as well as a treatment component 30, wherein the bearing 32 is eccentrically positioned on the guiding component 31 and, preferably, exhibits the same amount of an eccentricity e as the driving means 5 in the driving component 3. In order to obtain a substantially axially rotating movement of the tool 4", an equally oriented eccentricity e of driving means 5 and bearing 32 in the guide component 31 of the tool 4" may be provided. This is effected by a positive locking element 33 which cooperates with the positive locking means formed as indentation 11 on the driving means 5.

Figure 8:
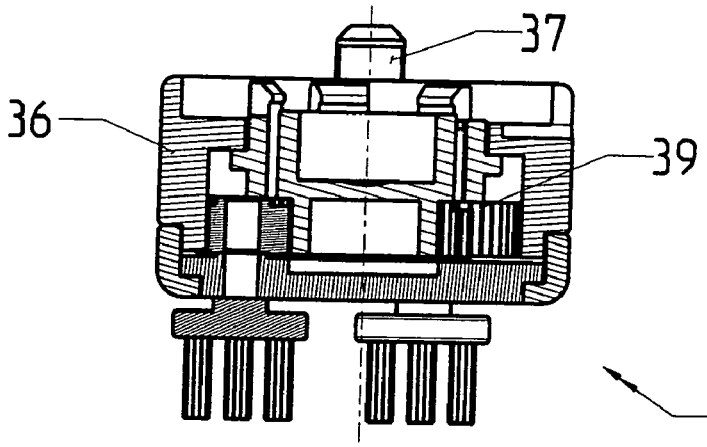
FIG. 8 shows a partially sectioned cut-out portion of the hand-guided device in the region of the drive component with a tool formed by a dirt milling tool.
Figure 8B:
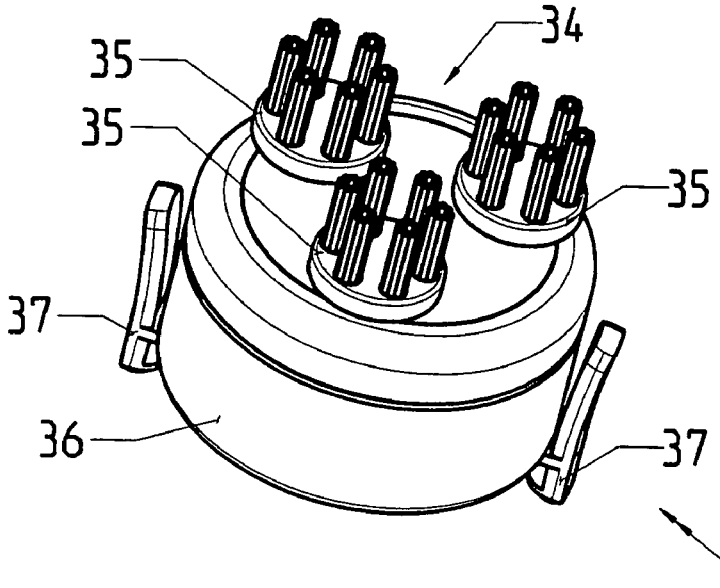
FIG. 8B shows the tool according to FIG. 8 in a perspective view from below.
Figure 8A:
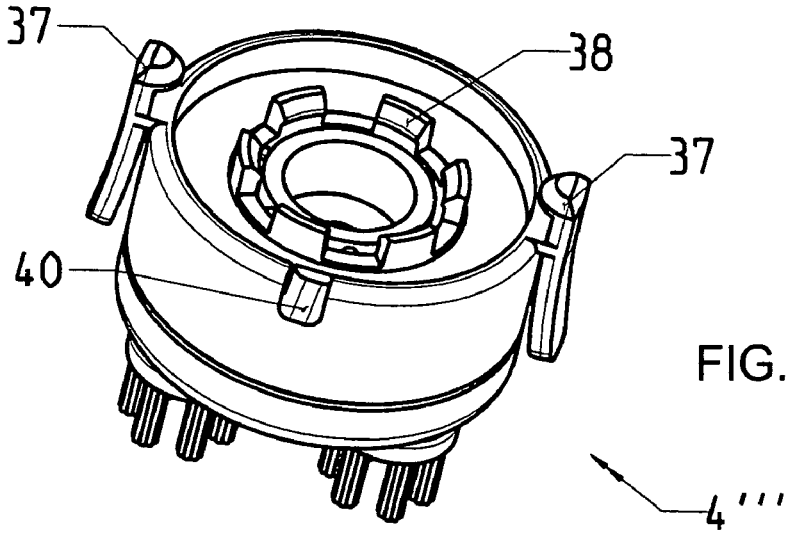
FIG. 8A shows the tool according to FIG. 8 in a perspective view from above.

Finally, FIGS. 8, 8A and 8B show a tool 4'" designed as a so-called dirt milling tool which mainly serves for removing dirt from the surfaces of objects, e.g. shoes. In the embodiment illustrated, the treatment component 34 of the tool 4'" comprises three rotatably mounted brushes 35. Also fewer or more individual brushes 35 may be arranged. Moreover, the tool 4'" comprises a housing 36 with snap-in noses 37 provided thereon. The snap-in noses 37 may be integrally produced with the tool-housing 36, as can be recognized from the sectional illustration according to FIG. 8. The snap-in noses 37 snap into the undercut portions 13' (cf. FIG. 1A) provided on the housing 2 of the hand-guided device and provide the required retention for the tool 4'" on the device 1. Via a claw coupling 38, a non-rotational connection to the driving means 5, and to the crown collar 11' of device 1 connected thereto can be established. On the tool-housing 36, a groove 40 is provided in which the fixed bearing 13 present on the housing 2 of the device 1 engages and additionally protects the tool 4'" against rotation relative to the device 1. The claw coupling 38 connected to the driving means 5 is operatively connected to the brushes 35 via a gearing 39. In the example illustrated, the gearing 39 is formed by a planetary gearing, wherein the center wheel of the planetary gearing is non-rotationally connected to the claw coupling 38. The brushes 35 are each non-rotationally connected to a toothed wheel, which brushes rotate around the center gear as planetary wheels. In this manner, a diametrically opposed rotational movement of the individual brushes 35 is obtained, whereby a particularly good cleaning effect can be achieved with this tool 4'".

The hand-guided device 1 and the tools 4, 4', 4", 4'" connectable thereto can be designed in various ways within the scope of the invention and can be optimally adapted to their respective fields of use.

The invention claimed is:

1. A hand-guided device, comprising:

a housing;

a drive component including a drive element and a collar movable relative to said housing, said drive element being eccentrically movably mounted in said drive component with an eccentricity;

a fixed bearing being stationarily disposed on said housing, said fixed bearing being laterally remote from said drive component;

a motor for driving said drive component including said drive element and said collar; and a plurality of tools being configured to provide in cooperation with at least one component selected from the group consisting of the drive element, the collar and the fixed bearing, a plurality of different types of movements relative to the housing;

said plurality of tools being configured for a releasable connection to at least one component selected from the group consisting of said drive element and said collar.

2. The hand-guided device according to claim 1, wherein said drive element is configured with means for achieving a positively locked connection with at least one of the plurality of tool.

3. The hand-guided device according to claim 1, wherein said housing is formed with at least one undercut portion for anchoring therein a snap-in nose formed on one of the plurality of tools.

4. The hand-guided device according to claim 1, wherein at least one of the plurality of tools comprises a treatment component and a guiding component, and wherein a bearing for said drive element and gaps for receiving said fixed bearing are centrally provided on said guiding component, resulting in an oscillating movement of said at least one tool.

5. The hand-guided device according to claim 4, wherein said gaps are disposed in star shape on said guiding component of said at least one tool.

6. The hand-guided device according to claim 1, wherein at least one of the plurality of tools is configured in axial symmetry and comprises a treatment component and a guiding component, and wherein a bearing for said drive element is centrally disposed on said guiding component, resulting in an orbital circulating movement of said at least one tool.

7. The hand-guided device according to claim 1, wherein at least one of the plurality of tools is connectable in releasable operative connection to said drive element, said at least one tool comprises a treatment component and a guiding component, and a bearing for said drive element is eccentrically disposed on said guiding component.

8. The hand-guided device according to claim 7, wherein an eccentricity of said bearing substantially corresponds to the eccentricity of said drive element, resulting in a rotating movement of the at least one tool.

9. The hand-guided device according to claim 7, wherein said at least one tool comprises a positive locking element cooperating with a positive locking means on the drive element.

10. The hand-guided device according to claim 1, wherein at least one of the plurality of tools comprises a treatment component with at least one rotatably mounted brush and a tool housing, said tool housing is formed with a groove for receiving said fixed bearing, and a coupling element is operatively connected to said at least one brush for establishing a connection with said drive element, resulting in a rotational movement of said at least one brush of said at least one tool.

11. The hand-guided device according to claim 10, wherein said tool housing is formed with at least one snap-in nose for establishing a connection with at least one undercut portion on said housing.

12. The hand-guided device according to claim 10, which further comprises a gearing connecting said coupling element to said at least one brush.

13. The hand-guided device according to claim 12, wherein said at least one brush defines a first brush, said gearing also connects said coupling element to a second brush, said gearing is formed by a planetary gear including a center gearwheel operatively connected to said coupling element, wherein the planetary gear further includes a plurality of planetary gearwheels coupled to said center gearwheel, wherein a first one of the plurality of gearwheels is operatively connected to said first brush, and wherein a second one of the plurality of planetary gearwheels is operatively connected to said second brush.

14. The hand-guided device according to claim 1, wherein said drive element is formed with a detent for arresting at least one of the plurality of tools.

15. The hand-guided device according to claim 14, which comprises an ejector pin shiftable by way of a pressure force acting from said housing towards said at least one tool for releasing said at least one tool from said detent.

16. The hand-guided device according to claim 1, wherein said motor is an electric motor.

17. The hand-guided device according to claim 1 wherein one of said plurality of tools includes:

a treatment component;

a guiding component connected to said treatment component; and a connecting element carried by said guiding component;

said connecting element including a drive element bearing, said drive element bearing being centrally disposed on said guiding component and being releasably connected to the drive element of the hand-guided device;

said connecting element furthermore including gaps formed in said guiding component, said gaps receiving the fixed bearing of the hand-guided device;

the tool cooperating with the hand-guided device resulting in an oscillating movement of the one of said plurality of tools.

18. The hand-quided device according to claim 17, wherein said gaps are configured in a star shape on said guiding component.

19. The hand-guided device according to claim 17, wherein said treatment component is formed of a sponge body.

20. The hand-guided device according to claim 19, which further comprises a pasty substance in said sponge body.

21. The hand-guided device according to claim 20, wherein said sponge body is formed by a sponge ring and an applicator connected to said sponge ring, said pasty substance is carried within said sponge ring and said applicator is formed of a material permeable to said pasty substance.

22. The hand-guided device according to claim 17, which further comprises a cover cap disposed over said treatment component.

23. The hand-guided device according to claim 22, wherein said cover cap is releasably connected to said guiding component.

24. The hand-guided device according to claim 1 wherein one of said plurality of tools includes:

a treatment component including at least one rotatably mounted brush;

a guiding component connected to said treatment component;

a coupling element disposed on said guiding component and operatively connected to said at least one brush to cause a rotational movement of the at least one brush, said coupling element being releasably connected to the drive component of the hand-guided device; and a tool-housing formed with a groove, said groove engaging the fixed bearing of the hand-guided device.

25. The hand-guided device according to claim 24, which further comprises at least one snap-in nose mounted to said tool-housing for establishing a connection with at least one undercut portion on the housing of the hand-guided device.

26. The hand-quided device according to claim 24, which comprises a gearing connecting said coupling element to said at least one brush.

27. The hand-guided device according to claim 26, wherein said at least one brush defines a first brush, said gearing also connects said coupling element to a second brush, said gearing is formed by a planetary gear including a center gearwheel operatively connected to said coupling element, wherein the planetary gear includes a plurality of planetary gearwheels coupled to said center gearwheel and wherein a first one of the plurality of gearwheels is operatively connected to said first brush, and a second one of the plurality of planetary gearwheels is operatively connected to said second brush.

28. The hand-guided device according to claim 1 wherein one of said plurality of tools includes:

a treatment component; and a guiding component connected to said treatment component, said guiding component including a drive component bearing, said drive component bearing being releasably connected to the drive component of the hand-guided device;

said guiding component including a recess, said recess being adapted and configured for receiving the drive element of the hand-guided device; and the fixed bearing of the hand-guided device being arranged at a distance from both the guiding component and the treatment component.

29. The hand-guided device according to claim 1, wherein the plurality of different types of movements relative to the housing include at least a rotational movement, an orbital circulating movement, and an oscillating movement.

* * * * *

UNITED STATES PATENT AND TRADEMARK OFFICE

CERTIFICATE OF CORRECTION

PATENT NO. : 8,185,992 B2
APPLICATION NO. : 11/794410
DATED : May 29, 2012
INVENTOR(S) : Johannes Linsbichler et al.

It is certified that error appears in the above-identified patent and that said Letters Patent is hereby corrected as shown below:

Title Page;

Item [73] should read as follows:

Good Vibrations Fit Durch Schwingung E.K. INH. Volker Halter,
Ulm (DE)

Signed and Sealed this
Second Day of October, 2012

David J. Kappos

David J. Kappos
*Director of the United States Patent and Trademark Office*